US005549127A

United States Patent [19]

Chang

[11] Patent Number: 5,549,127

[45] Date of Patent: Aug. 27, 1996

[54] SPRING FIXING STRUCTURE FOR A HAIRGRIP

[76] Inventor: Wen-Hsiung Chang, No. 32, Lane 232, Chung Shan Road, Tainan, Taiwan

[21] Appl. No.: 433,044

[22] Filed: May 3, 1995

[51] Int. Cl.[6] ..... A45D 8/20

[52] U.S. Cl. ..... 132/277; 132/276; 132/279; 24/510

[58] Field of Search ..... 132/276, 277, 132/279, 282, 273; 24/510

[56] References Cited

U.S. PATENT DOCUMENTS 1,936,838 11/1933 Hermsdorf ..... 132/277

2,540,042 1/1951 Craigen et al. ..... 132/277

2,549,193 4/1951 Grison ..... 132/277

*Primary Examiner*—John G. Weiss

*Assistant Examiner*—Pedro Philogene

*Attorney, Agent, or Firm*—Morton J. Rosenberg; David I. Klein

[57] ABSTRACT

A spring fixing structure for a hairgrip includes a pin having an oval head and a plurality of annular projections in an intermediate portion engaging a wound coiled portion of a spring forcibly interposed between two ears of two hairgrip bodies after the pin is inserted through a center hole of the spring and of the two ears, and thus the pin, the spring and the two hairgrip bodies may be combined pivotally and stably together.

2 Claims, 4 Drawing Sheets

SPRING FIXING STRUCTURE FOR A HAIRGRIP

BACKGROUND OF THE INVENTION

This invention concerns a spring fixing structure for a hairgrip, particularly one easily combining two hairgrip bodies with a pin and a spring.

A known conventional hairgrip shown in FIG. 5 includes two hairgrip bodies 1, 1, one of the hairgrip body having a toothed front portion 11 and a rear pressing portion 12, two ears 13, 13 spaced apart on the rear pressing portion 12 and respectively having a center hole 14, a coiled spring 2 placed between the two ears 13, 13, and a pin 3 inserted through the holes 14, 14 of the two ears 13, 13 and the center hole of the coiled spring 2 and having a head 31 stopped at one ear 13 at a right side and a flat end 32 at left side for preventing the pin 3 from loosening off the spring 2 and the two ears 13, 13.

The structure of the pin 3 is clumsy and costly because of the flat end 32, which has to be pressed by means of a mold for pressing, and the pin 3 is apt to be broken or bent in pressing process.

SUMMARY OF THE INVENTION

This invention has been devised to offer a spring fixing structure for a hairgrip.

A spring fixing structure in the present invention includes a pin having a plurality of annular in an intermediate portion to engage with a wound coiled portion of a spring forcibly inserted between two ears of two hairgrip bodies after the pin is inserted through center holes of the two ears and a center hole of the spring. The engagenment of the annular projections of the pin and the wound coiled portion of the spring keeps the pin, the spring and the two hairgrip bodies pivotally and stably combined together.

BRIEF DESCRIPTION OF DRAWINGS

The invention will be better understood by reference to the accompanying drawing, wherein.

DESCRIPTION OF THE PREFERRED EMBODIMENTS

Figure 1:
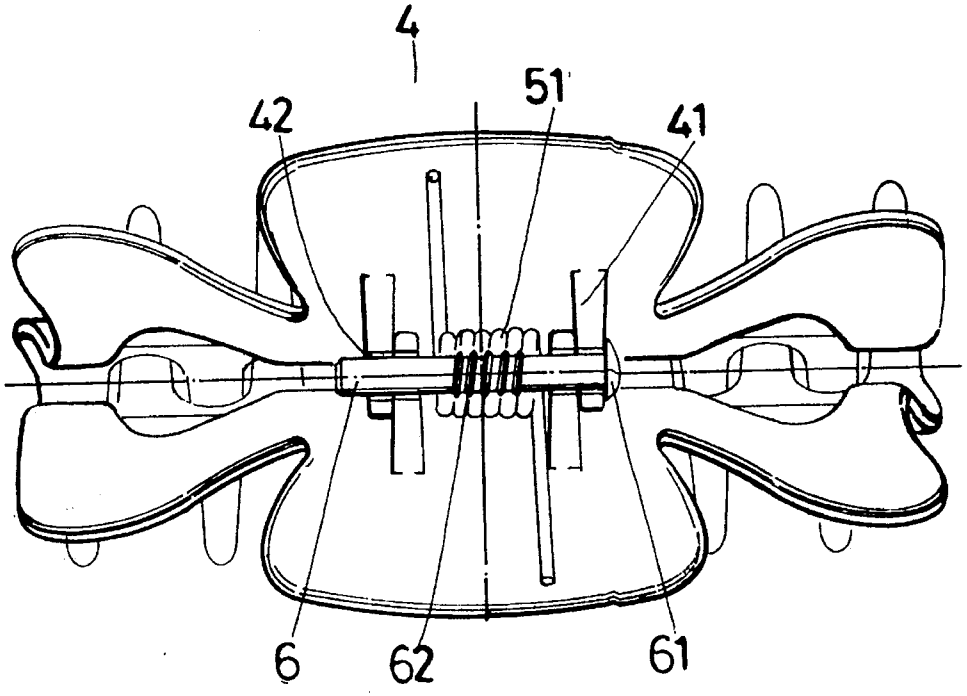
FIG. 1 is an upside view of a spring fixing structure for a hairgrip in the present invention.
Figure 2:
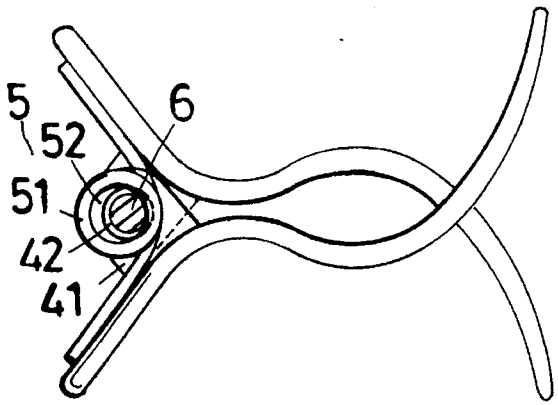
FIG. 2 is a side view of the spring fixing structure for a hairgrip in the present invention.

A spring fixing structure for a hairgrip in the present invention, as shown in FIGS. 1 and 2, includes a spring 5 and a pin 6 combined together with two hairgrip bodies 4, 4.

Figure 3:
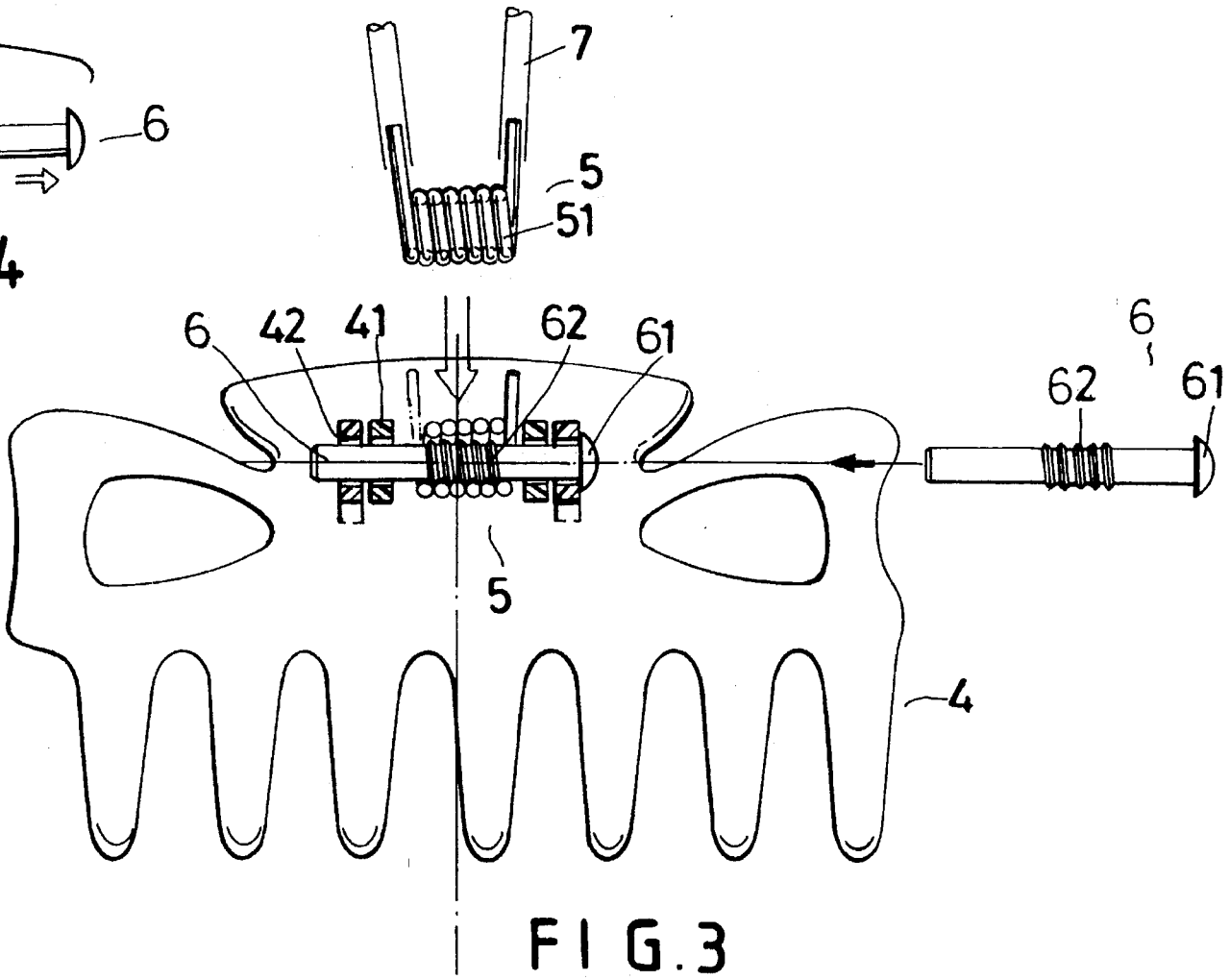
FIG. 3 is an exploded elevational view, partially cut-away, of the spring fixing structure for a hairgrip in the present invention.
Figure 4:
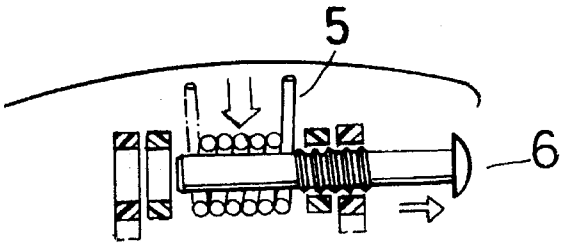
FIG. 4 is a side view of a pin in the spring fixing structure for a hairgrip in the present invention, showing it being pulled out.
Figure 5:
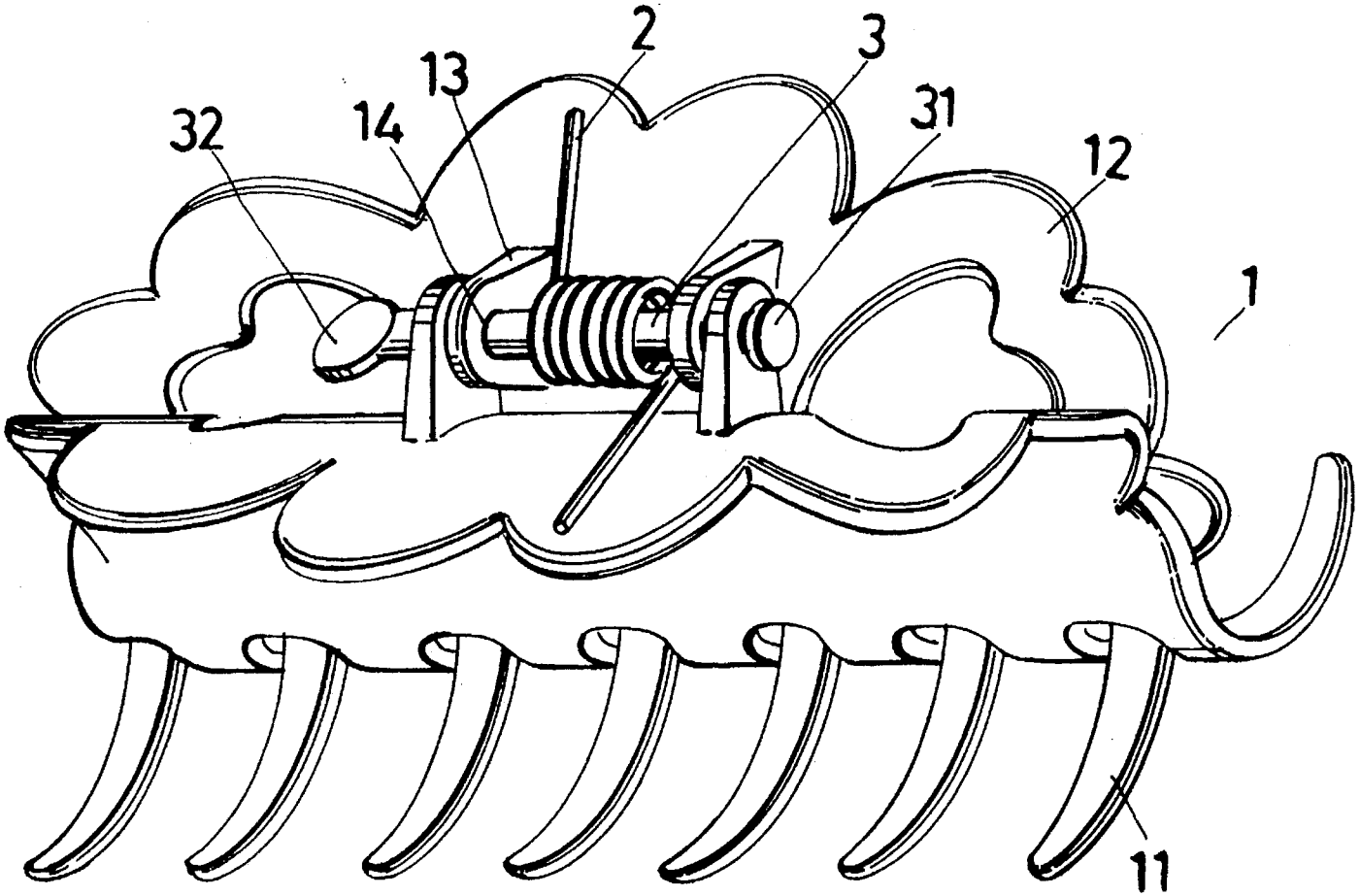
FIG. 5 (PRIOR ART)
FIG. 5 is a perspective view of a known conventional spring engaging structure for a hairgrip; and, FIG. 6 is an exploded elevational view, partially cut-away, of an alternate embodiment of the spring fixing structure for a hairgrip of the present invention.
Figure 6:
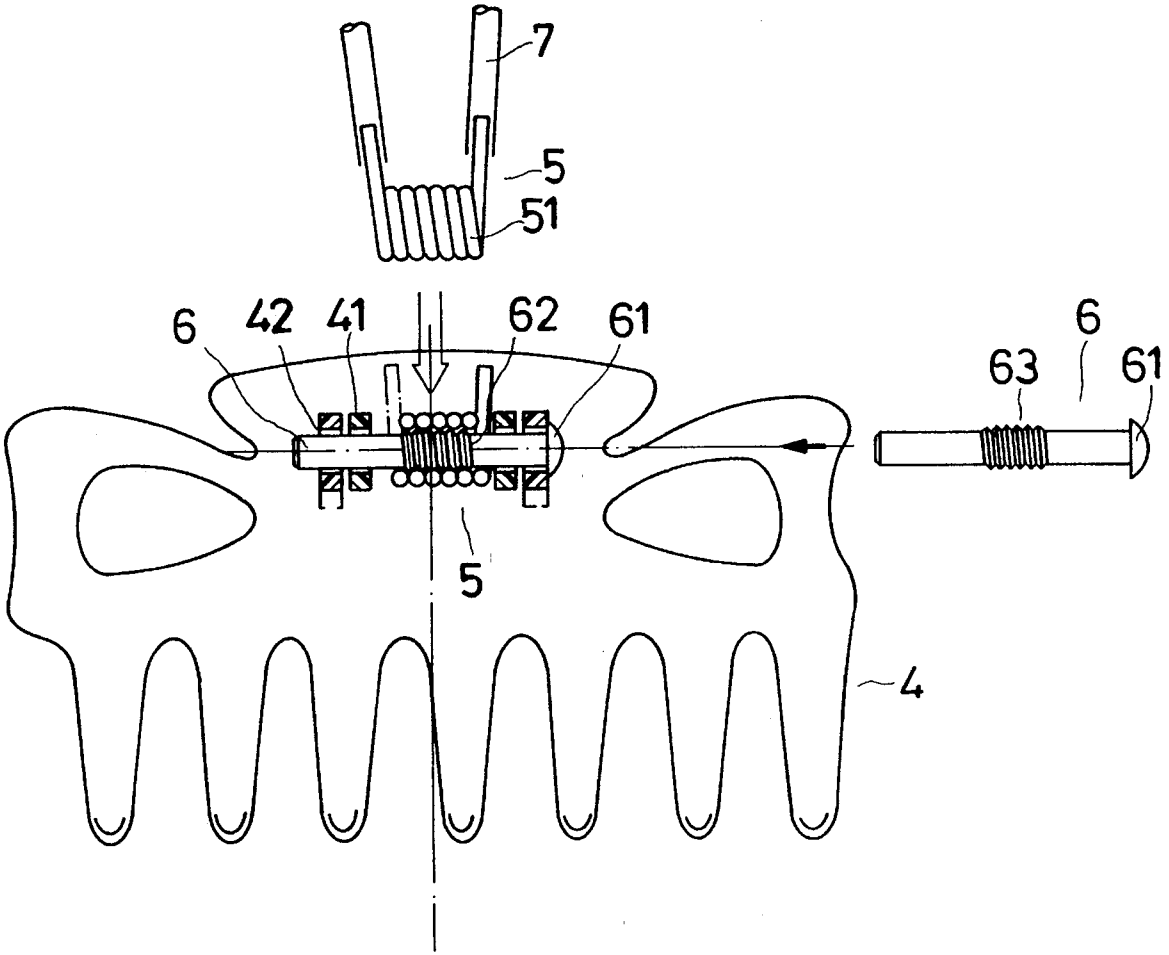

The two hairgrip bodies 4, 4 has the same structure as the conventional hairgrip, and the main different structure is a pin 6 having a proper length and an oval head 61 and a plurality of annular projections 62 in the intermediate portion. After two ears 41, 41 of the two hairgrip bodies 4, 4 are fitted with each other, a spring 5 with two tubes 7, 7 fitted around two ends thereof is forcibly interposed between the two ears 41, as shown in FIG. 3. The ears 41, 41 have a center holes 42 and the spring 5 also has a center hole 52, and those center holes 42, 42, 52 are made to align straight so that the pin 6 may be inserted through those center holes 42, 42, 52 and the annular projections 62 of the pin 6 may engage with the wound coiled portion 51 of the spring 5. Thus, the spring 5 is kept in combined condition with the two hairgrip bodies 4, 4 by the pin 6, which is kept not easily separable from the spring 5. In case that the pin 6 is needed to be pulled out, the wound coiled portion 51 of the spring 5 has to be held with force to let the portion 51 disengage from the annular projections 62 of the pin 6. In the alternate embodiment of the invention shown in FIG. 6, a plurality of threads 63 are formed on the intermediate shaft portion of the pin 6 to serve the function served by annular projections 62 in the preferred embodiment.

As can be understood from the above description, the spring fixing structure for a hairgrip in this invention has advantages as follows:

1. The pin in this invention has a plurality of annular projections in its intermediate portion to engage with the wound coiled portion of the spring to keep the pin from separating from the spring so as to combine the two hairgrip bodies, the spring and the pin together, but the known conventional hairgrip has a pin, which has one end pressed flat to prevent the pin from loosening off the spring, and an extra mold is needed to press the end flat, which raises up the cost.

2. The pin in this invention does not have such a length needed in the known conventional hairgrip, increasing outward beauty of the hairgrip, but the pin in the conventional hairgrip should have a length enough to stick out of the two ears of the hairgrip bodies and then pressed flat to prevent the pin from separating from the spring, reducing its outward beauty and worthiness feeling.

3. The pin is detachable from the spring, with every components of the hairgrip replaceable in case of breaking.

While the preferred embodiments of the invention have been described above, it will be recognized and understood that various modifications may be made therein and the appended claims are intended to cover all such modifications which may fall within the spirit and scope of the invention.

What is claimed is:

1. A clip system comprising:

(a) a plurality of clip bodies;

(b) a coil spring member coupled to said clip bodies for biasing at least a portion of one of said clip bodies against at least a portion of another of said clip bodies, said coil spring member having a wound coil portion defining a substantially tubular center passage; and, (c) a pin member pivotally coupling together said clip bodies and said coil spring member, said pin member having an elongate shaft portion inserted into said center passage of said coil spring member, said shaft portion having formed thereon a plurality of annular projections engaging said wound coil portion of said coil spring member, whereby said pin member is operably retained within said center passage of said coil spring member.

2. A clip system comprising:

(a) a plurality of clip bodies;

(b) a coil spring member coupled to said clip bodies for biasing at least a portion of one of said clip bodies against at least a portion of another of said clip bodies, said coil spring member having a wound coil portion defining a substantially tubular center passage; and, (c) a pin member pivotally coupling together said clip bodies and said coil spring member, said pin member having an elongate shaft portion inserted into said center passage of said coil spring member, said shaft portion having formed thereon a plurality of threads engaging said wound coil portion of said coil spring member, whereby said pin member is operably retained within said center passage of said coil spring member.

* * * * *